US007010934B2

(12) United States Patent
Choi et al.

(10) Patent No.: US 7,010,934 B2
(45) Date of Patent: Mar. 14, 2006

(54) ICEMAKER

(75) Inventors: Sang-keun Choi, Kwangju-si (KR); Eui-young Chang, Suwon-si (KR)

(73) Assignee: Samsung Electronics Co., Ltd., (KR)

( * ) Notice: Subject to any disclaimer, the term of this patent is extended or adjusted under 35 U.S.C. 154(b) by 0 days.

(21) Appl. No.: 10/821,168

(22) Filed: Apr. 9, 2004

(65) Prior Publication Data

US 2005/0160757 A1 Jul. 28, 2005

(30) Foreign Application Priority Data

Jan. 28, 2004 (KR) ..... 10-2004-0005428

(51) Int. Cl.
*F25C 1/04* (2006.01)

(52) U.S. Cl. ..... 62/353; 249/127; D15/90

(58) Field of Classification Search ..... 62/340–356; 249/70, 119, 120; 240/127; D15/90
See application file for complete search history.

(56) References Cited

U.S. PATENT DOCUMENTS 3,642,162 A * 2/1972 Doman et al. ..... 220/659
3,696,635 A * 10/1972 Fogt ..... 62/344
3,930,376 A * 1/1976 Schwartz ..... 62/320
D244,275 S * 5/1977 Gurbin ..... D15/90
4,306,423 A * 12/1981 Webb et al. ..... 62/353
4,789,130 A * 12/1988 Stich et al. ..... 249/120
D318,281 S * 7/1991 McKinlay ..... D15/90
6,481,235 B1 * 11/2002 Kwon ..... 62/353
D496,374 S * 9/2004 Zimmerman ..... D15/90

FOREIGN PATENT DOCUMENTS

| | | | |
|---|---|---|---|
| GB | 977699 | | 12/1964 |
| JP | 5-248746 | * | 9/1993 |
| JP | 2003-0031762 A | | 4/2003 |
| KR | 1999-0009711 | | 2/1999 |
| KR | 2000-0011102 | | 6/2000 |

* cited by examiner

*Primary Examiner*—William E. Tapolcai
(74) *Attorney, Agent, or Firm*—Sughrue Mion, PLLC

(57) ABSTRACT

The present invention relates to an icemaker in which an ice cube tray is twisted by rotation of an actuator to easily and effectively release ice from the ice cube tray.

The icemaker comprising an ice cube tray formed with cube compartments; an actuator rotating the ice cube tray; and a stopper coming into contact with the ice cube tray being rotated and allowing the ice cube tray to be twisted, the cube compartments being diagonally arranged with respect to a lengthwise direction of the ice cube tray. With this configuration, the present invention provides an icemaker in which an ice is easily released from an ice cube tray and minimally cracked or broken while being released.

11 Claims, 9 Drawing Sheets

ICEMAKER

CROSS-REFERENCE TO RELATED APPLICATIONS

This application claims the benefit of Korean Patent Application No. 2004-5428, filed Jan. 28, 2004, in the Korean Intellectual Property Office, the disclosure of which is incorporated herein by reference.

BACKGROUND OF THE INVENTION

1. Field of the Invention

The present invention relates to an icemaker, and more particularly, to an icemaker in which an ice cube tray is twisted by rotation of an actuator to easily and effectively release ice from the ice cube tray.

2. Description of the Related Art

Generally, an icemaker for freezing water into ice is being widely applied to home appliances such as a refrigerator, a water purifier, etc.

Most of conventional icemaker comprises an ice cube tray formed with a plurality of cube compartments; a motor coupled to the ice cube tray and rotating the ice cube tray; and a stopper coming into contact with the ice cube tray rotated by the motor and allowing the ice cube tray to be twisted.

In the foregoing conventional icemaker, water filled in the cube compartments of the ice cube tray is frozen into ice by cool air discharged from a separate cooler, and then the ice is released from the ice cube tray rotated and twisted by the motor, so that the ice is transferred to an ice storage bin.

Particularly, as shown in FIG. 1, a conventional ice cube tray 2 comprises cube compartments 4 having an oblong shape and arranged perpendicularly to a lengthwise direction of the ice cube tray 2; and a motor coupling groove 6 and a supporting shaft 8 respectively formed at opposite ends of the ice cube tray 2.

However, in the ice cube tray 2, because the cube compartments 4 having the oblong shape are arranged perpendicularly to a lengthwise direction of the ice cube tray 2, that is, because the longitudinal direction of the cube compartment is perpendicular to the lengthwise direction of the ice cube tray 2, ice is likely to be cracked or broken as the ice cube tray 2 is rotated and twisted by a motor connected to a motor coupling groove 6 in order to release the ice from the ice cube tray 2. Accordingly, there arises a problem to make quality ice.

Further, when the cube compartments are arranged parallel with the lengthwise direction of the ice cube tray, that is, when the longitudinal direction of the cube compartment is parallel with the lengthwise direction of the ice cube tray 2, the ice is relatively prevented from being cracked or broken but is not easily released from the ice cube tray 2.

SUMMARY OF THE INVENTION

Accordingly, it is an aspect of the present invention to provide an icemaker which can prevent ice from being cracked or broken while releasing the ice from an ice cube tray.

Additional aspects and/or advantages of the invention will be set forth in part in the description which follows and, in part, will be obvious from the description, or may be learned by practice of the invention.

The foregoing and/or other aspects of the present invention are achieved by providing an icemaker comprising an ice cube tray formed with cube compartments; an actuator rotating the ice cube tray; and a stopper coming into contact with the ice cube tray being rotated and allowing the ice cube tray to be twisted, the cube compartments being diagonally arranged with respect to a lengthwise direction of the ice cube tray.

According to an aspect of the invention, the cube compartments are arranged at an angle of about 40°~50° with respect to the lengthwise direction of the ice cube tray.

According to an aspect of the invention, each of the cube compartments has an oblong shape.

According to an aspect of the invention, the cube compartment has a crescent shape.

According to an aspect of the invention, the icemaker further comprises a supporting bracket supporting the actuator and the ice cube tray, wherein the stopper is provided in one side of the supporting bracket.

According to an aspect of the invention, the ice cube tray is formed with an ice-releasing portion at one side thereof to come into contact with the stopper.

BRIEF DESCRIPTION OF THE DRAWINGS

These and other aspects and advantages of the present invention will become apparent and more readily appreciated from the following description of the embodiments, taken in conjunction with the accompany drawings of which.

DETAILED DESCRIPTION OF THE PREFERRED EMBODIMENT

Figure 1:
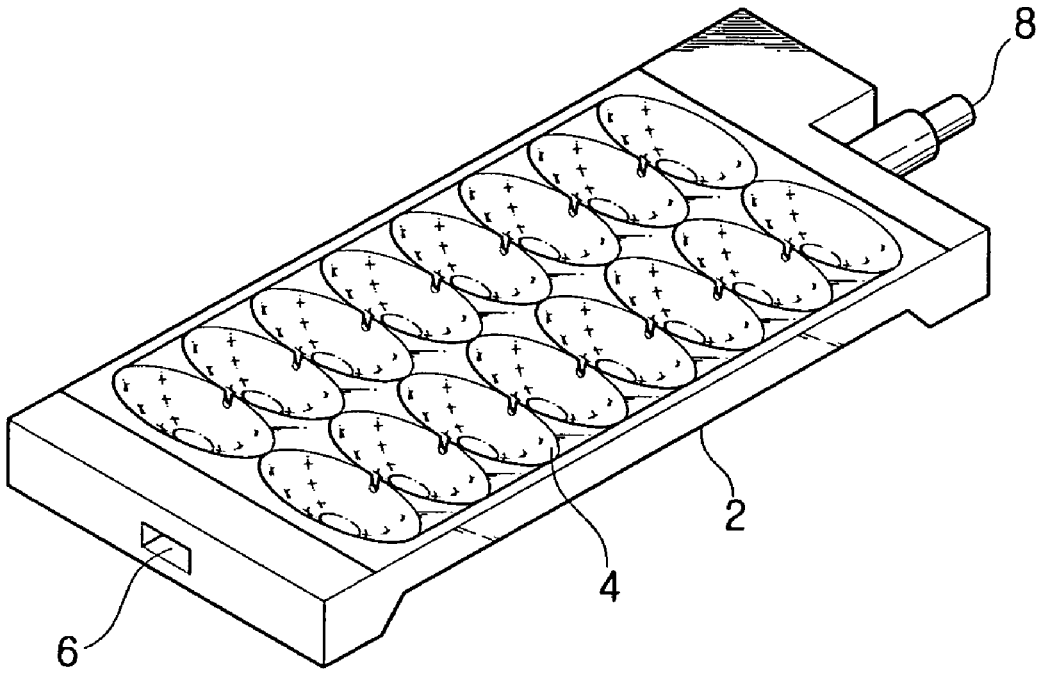
FIG. 1 (PRIOR ART)
FIG. 1 is a perspective view of an ice cube tray used in a conventional icemaker.
Figure 2:
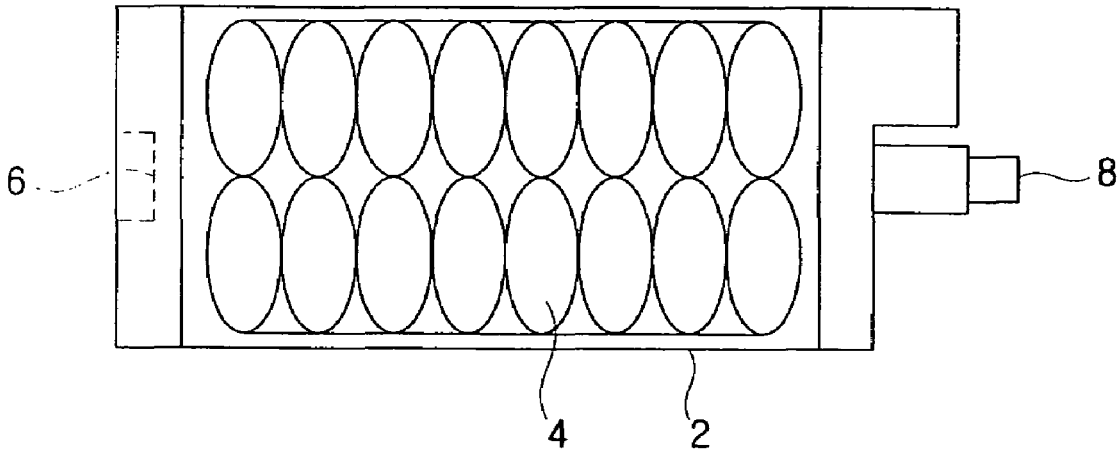
FIG. 2 (PRIOR ART)
FIG. 2 is a plan view of FIG. 1.

Reference will now be made in detail to the embodiments of the present invention, examples of which are illustrated in the accompanying drawings, wherein like reference numerals refer to like elements throughout. The embodiments are described below in order to explain the present invention by referring to the figures.

Figure 3:
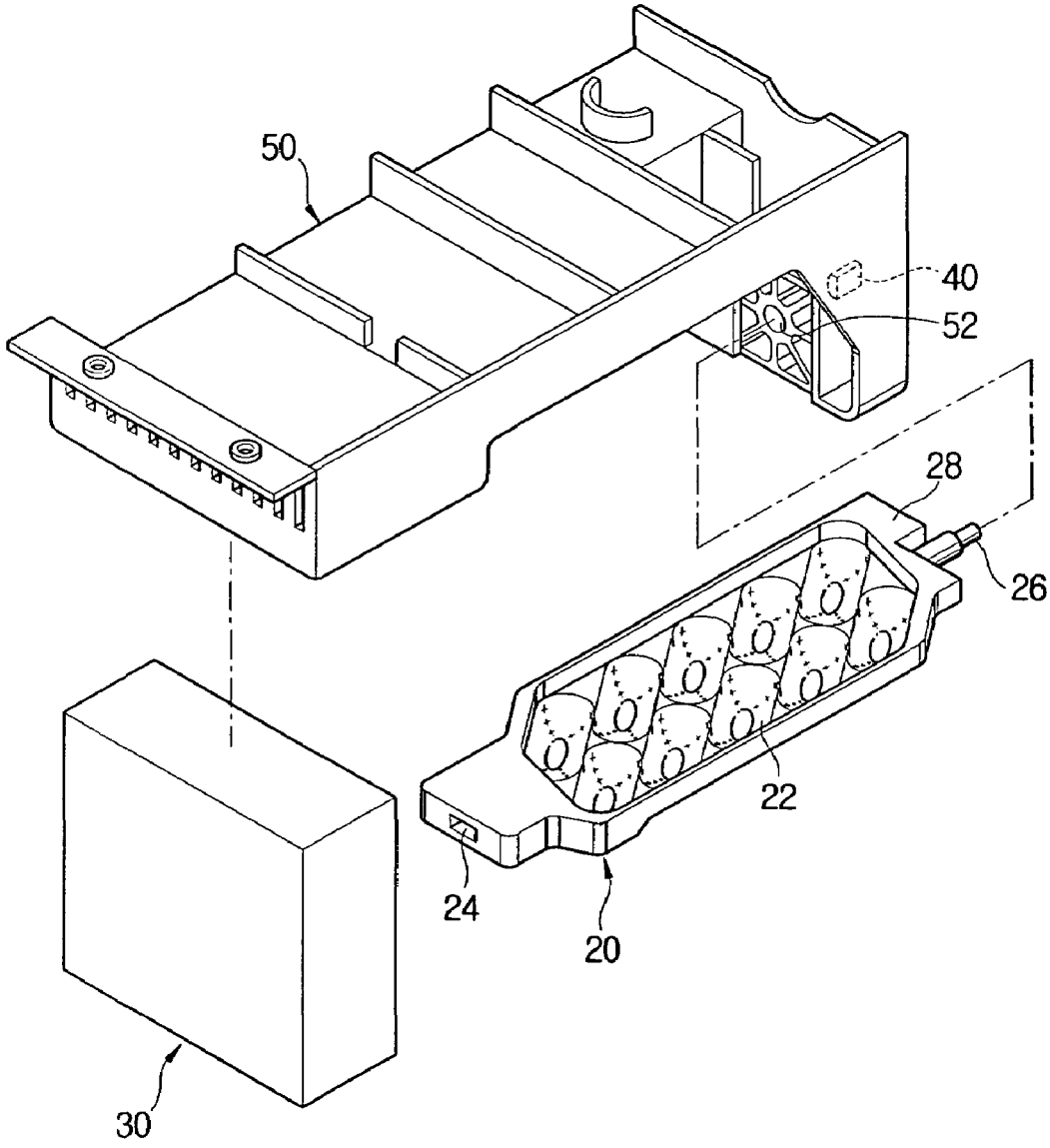
FIG. 3 is an exploded perspective view of an icemaker according to a first embodiment of the present invention.
Figure 4:
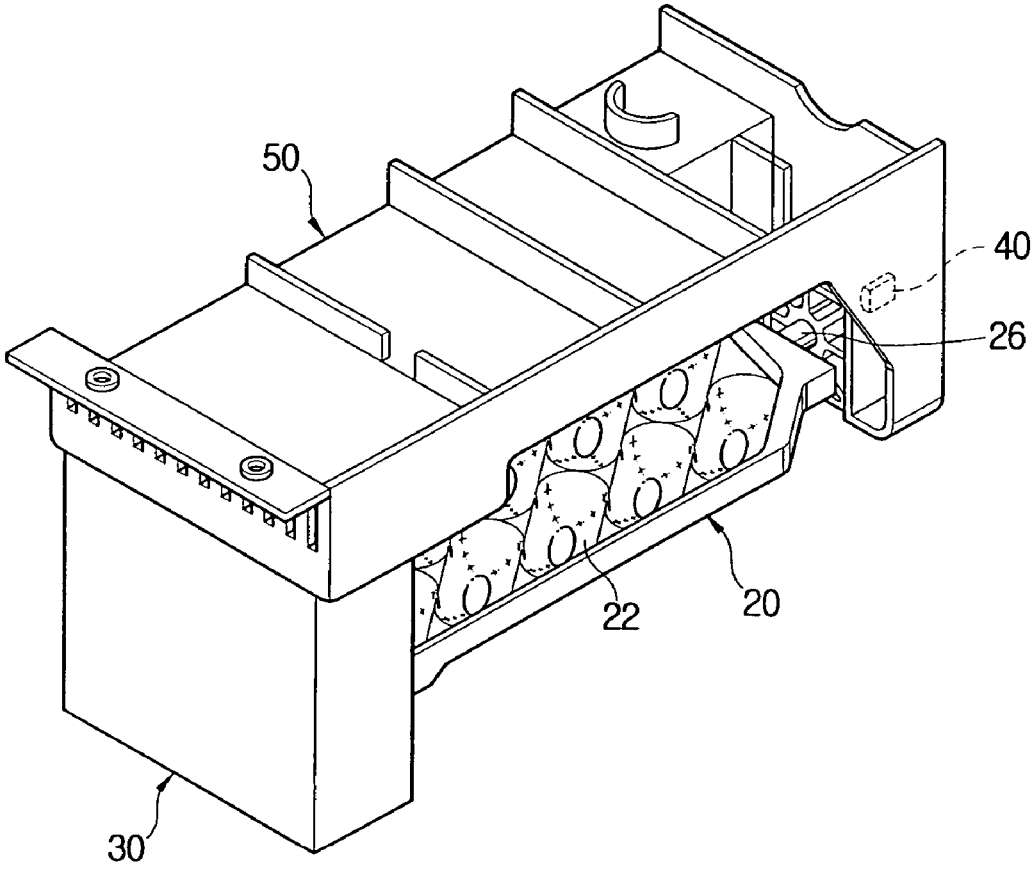
FIG. 4 is an assembled perspective view of the icemaker of FIG. 3.

FIG. 3 is an exploded perspective view of an icemaker according to a first embodiment of the present invention; FIG. 4 is an assembled perspective view of the icemaker of FIG. 3; and FIG. 5 is a perspective view of the icemaker according to the first embodiment of the present invention, illustrating operation of an ice cube tray.

Figure 5:
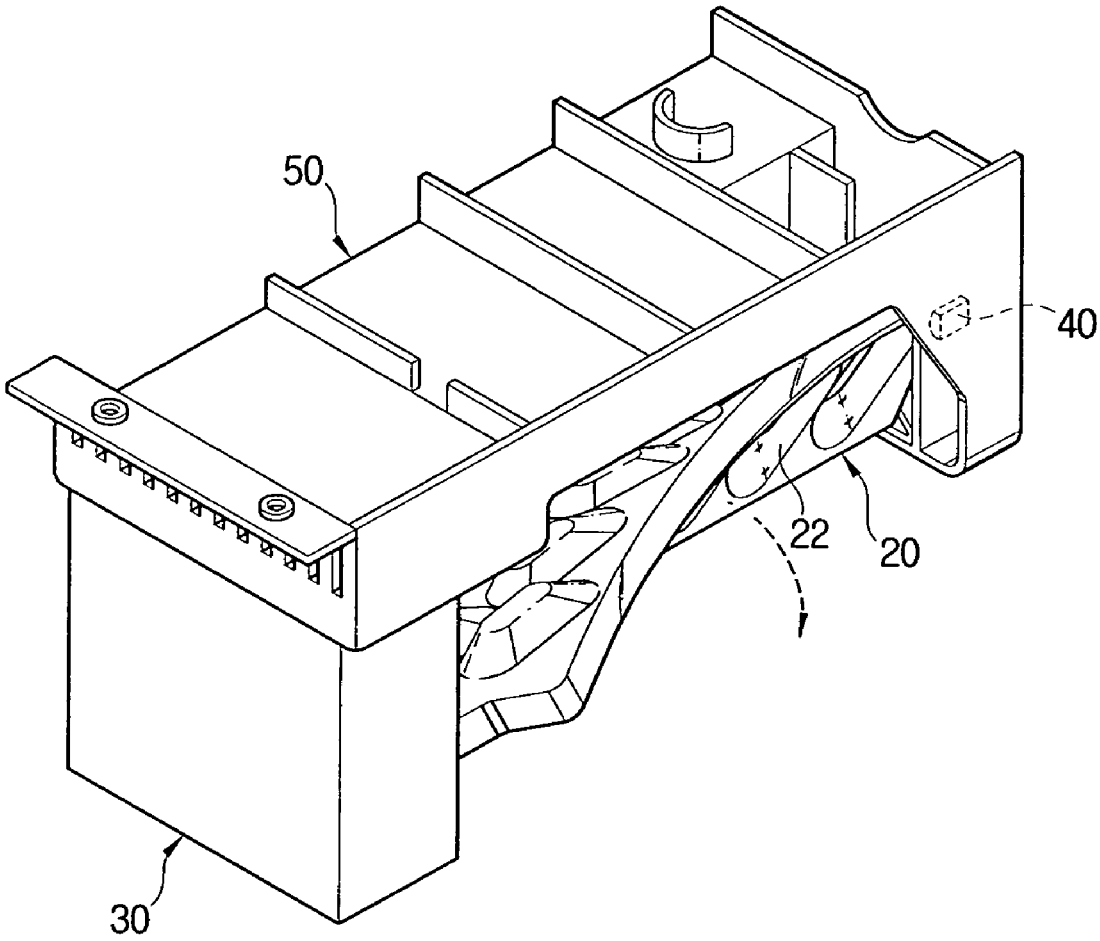
FIG. 5 is a perspective view of the icemaker according to the first embodiment of the present invention, illustrating operation of an ice cube tray.

As shown in FIGS. 3 through 5, an icemaker according to the present invention comprises an ice cube tray 20 formed with at least one cube compartment 22; an actuator 30 coupled to the ice cube tray 20 and rotating the ice cube tray 20; a stopper 40 coming into contact with the ice cube tray 20 and allowing the ice cube tray 20 to be twisted; and a supporting bracket 50 supporting the ice cube tray 20 and the actuator 30.

The ice cube tray 20 has an oblong shape. At opposite ends of the ice cube tray 20 are provided an actuator coupling groove 24 to be coupled to a rotating shaft (not shown) of the actuator 30, and a supporting shaft 26 allowing the ice cube tray 20 to be supported. The shape of the ice cube tray 20 can vary as long as the ice cube tray 20 is twisted to release ice therefrom.

The ice cube compartments 22 are arranged diagonally with respect to a lengthwise direction of the ice cube tray 20, and each of the ice cube compartments 22 preferably has an oblong shape to easily release the ice therefrom and to effectively prevent the ice from being cracked or broken because the ice is released from the ice cube compartment 22 by torsional stress due to rotation of the actuator 30.

The actuator 30 comprises a motor (not shown) providing a rotational force; and a rotating shaft (not shown) connecting the motor with the actuator coupling groove 24 of the ice cube tray 20 and transferring the rotational force of the motor to the ice cube tray 20, thereby rotating the ice cube tray 20 at a predetermined angle. The actuator 30 can be selected from a well-known technology as long as the actuator 30 transfers the rotational force to the ice cube tray 20.

The stopper 40 is provided in one side of the supporting bracket 50 and stops a portion of the ice cube tray 20 from rotating while the ice cube tray 20 is rotated, thereby causing the ice cube tray 20 to be twisted. The structure and the position of the stopper 40 may very as long as the stopper causes the ice cube tray 20 to be supported and twisted.

Further, a corner portion of the ice cube tray 20 is formed with an ice-releasing portion 28 to come into contact with the stopper 40.

The supporting bracket 50 is connected to the ice cube tray 20 and the actuator 30, and one side of the supporting bracket 50 is formed with a supporting shaft coupling groove 52 in correspondence to the supporting shaft 26 of the ice cube tray 20, wherein the supporting shaft 26 is inserted in the supporting shaft coupling groove 52. Herein, the structure of the supporting bracket 50 may vary as necessary.

With this configuration, the icemaker according to the first embodiment of the present invention is operated as follows.

First, the cube compartments 22 of the ice cube tray 20 is filled with water supplied from a water supplying part, and then the water is frozen into the ice by a cooling means such as cool air for a predetermined period of time.

Then, the actuator 30 is operated to rotate the ice cube tray 20 and to release the ice from the cube compartments 22. When the ice cube tray 20 is rotated and reaches a predetermined rotational angle, the ice-releasing portion 28 of the ice cube tray 20 comes into contact with the stopper 40 provided in the supporting bracket 50.

In the state that the ice-releasing portion 28 is supported by the stopper 40, the actuator 30 continuously rotates the ice cube tray 20, so that one portion of the ice cube tray is stopped and the other portion thereof is rotated, thereby twisting the ice cube tray 20. Thus, the cube compartments 22 are compressed in the longitudinal direction thereof, so that the ice is released from the cube compartment 22 and transferred to an ice storage bin (not shown) disposed below the ice cube tray 20.

Figure 6:
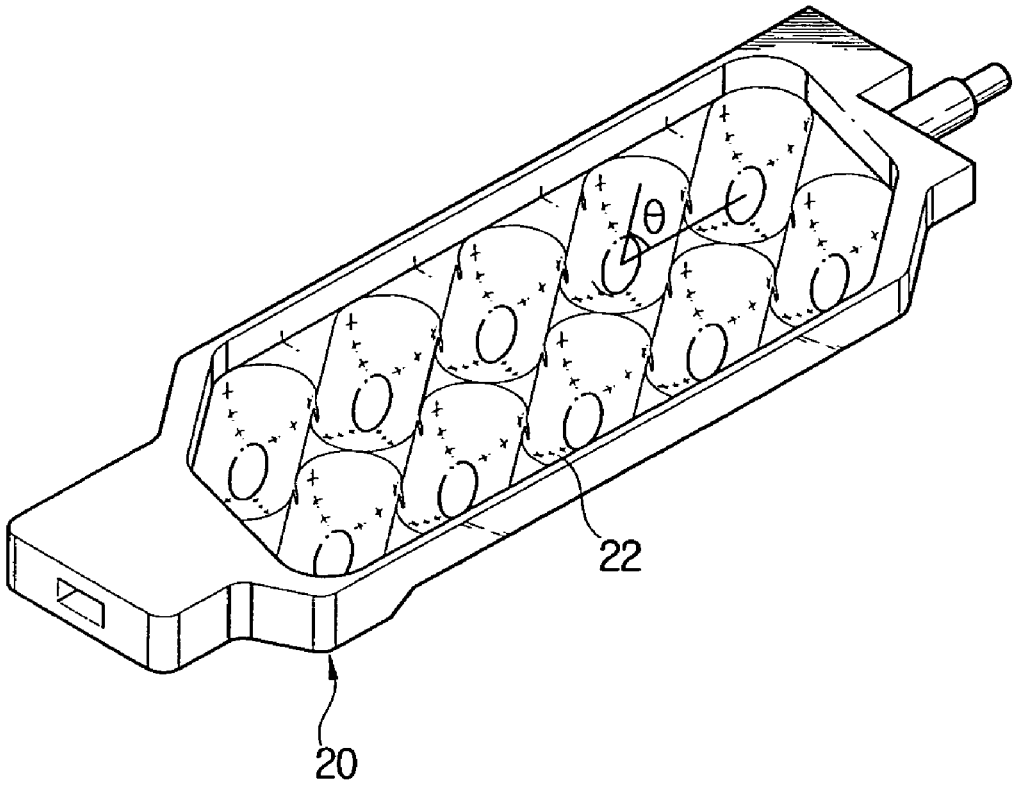
FIG. 6 is a perspective view of the ice cube tray used in the icemaker according to the first embodiment of the present invention.
Figure 7:
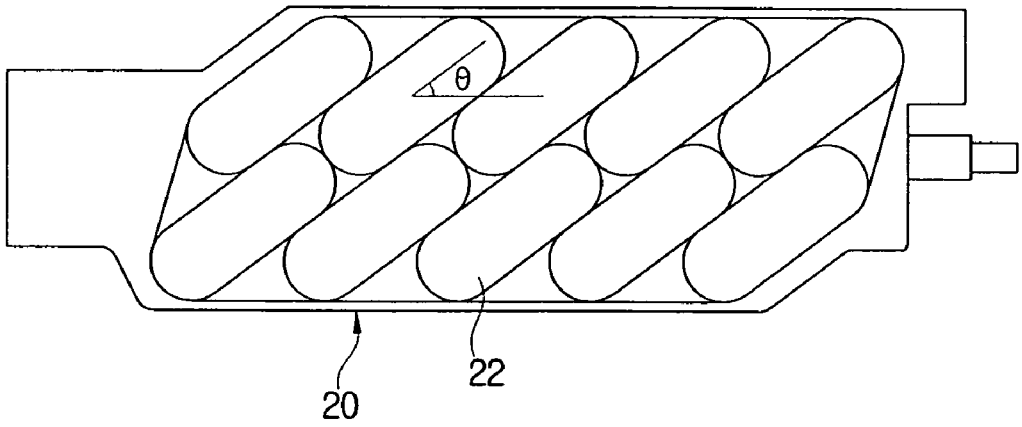
FIG. 7 is a plan view of the ice cube tray of FIG. 6.

FIG. 6 is a perspective view of the ice cube tray used in the icemaker according to the first embodiment of the present invention, and FIG. 7 is a plan view of the ice cube tray of FIG. 6.

As shown therein, the cube compartments 22 are diagonally arranged with respect to the lengthwise direction of the ice cube tray 20, that is, a predetermined inclination angle (θ) is formed between the longitudinal direction of the cube compartment 22 and the lengthwise direction of the ice cube tray 20. Here, the inclination angle (θ) can be properly adjusted as desired but is preferably within about 40°~50° at which the ice is easily released from the ice cube tray 20 and minimally cracked or broken while being released.

For example, the more the inclination angle (θ) between the longitudinal direction of the cube compartment 22 and the lengthwise direction of the ice cube tray 20 is decreased, the more the ice is relatively prevented from being cracked or broken but is not easily released from the ice cube tray 20. Oppositely, the more the inclination angle (θ) between the longitudinal direction of the cube compartment 22 and the lengthwise direction of the ice cube tray 20 is increased, the more the ice is easily released from the ice cube tray 20 but is likely to be cracked or broken.

Meanwhile, according to the present invention, the ice is most effectively released from the ice cube tray 20 in the case where the cube compartments 22 of the ice cube tray 20 has the oblong shape, particularly a crescent shape, However, the shape of the cube compartments 22 may vary as necessary.

Figure 8:
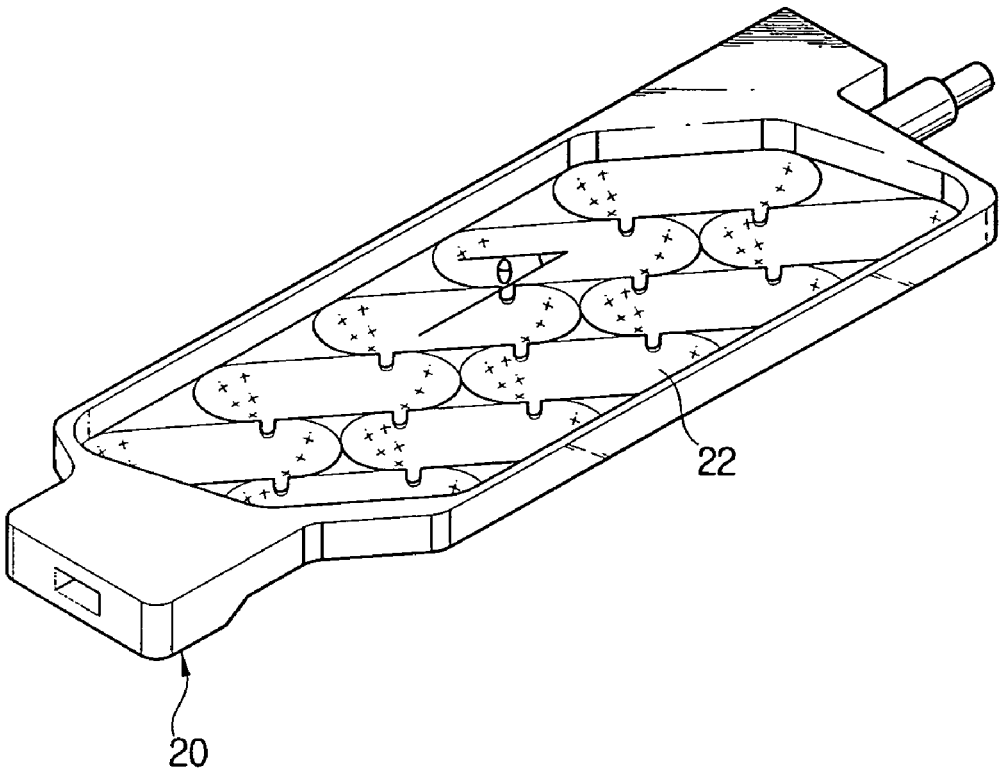
FIG. 8 is a perspective view of an ice cube tray according to a second embodiment of the present invention.
Figure 9:
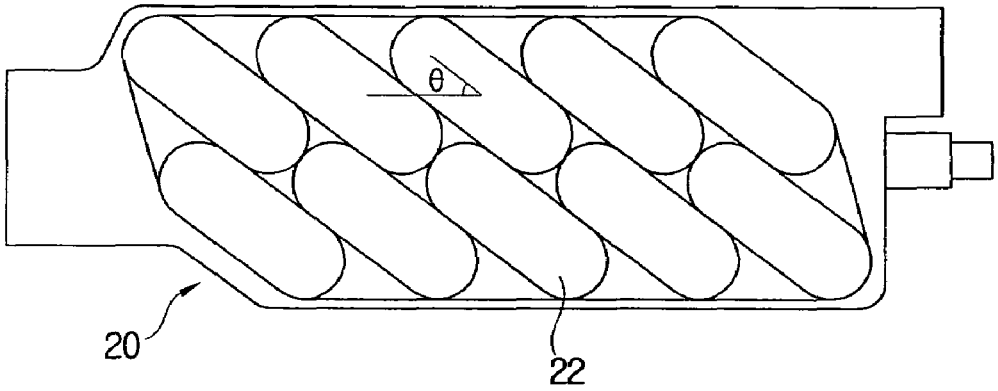
FIG. 9 is a plan view of the ice cube tray of FIG. 8.

FIG. 8 is a perspective view of an ice cube tray according to a second embodiment of the present invention, and FIG. 9 is a plan view of the ice cube tray of FIG. 8.

As shown therein, an ice cube tray 20 of an icemaker according to the second embodiment of the present invention is the same as the ice cube tray 20 of the first embodiment except the arranged structure of the cube compartments 22. That is, in the second embodiment the cube compartments 22 are arranged at a forward inclination angle with respect to the lengthwise direction of the ice cube tray 20, while in the first embodiment the cube compartments 22 are arranged at a backward inclination angle with respect to the lengthwise direction of the ice cube tray 20.

According to the second embodiment, the cube compartments 22 are tensioned transversely with respect to the lengthwise direction of the ice cube tray 20 while the ice cube tray 20 is twisted, thereby releasing the ice from the cube compartments 22.

As described above, cube compartments of an ice cube tray are arranged according to the present invention, so that an ice is easily released from the ice cube tray and minimally cracked or broken while being released. Thus, an icemaker according to the present invention is improved in usability and functionality and can make quality ice.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. An icemaker comprising an ice cube tray formed with cube compartments; an actuator rotating the ice cube tray; and a stopper coming into contact with the ice cube tray being rotated and allowing the ice cube tray to be twisted, the cube compartments being diagonally arranged with respect to a lengthwise direction of the ice cube tray, wherein the cube compartments are arranged at an angle of about 40°~50° with respect to the lengthwise direction of the ice cube tray.

2. The icemaker according to claim 1, wherein each of the cube compartments has an oblong shape.

3. The icemaker according to claim 2, wherein the cube compartments have a crescent shape.

4. The icemaker according to claim 1, further comprising a supporting bracket supporting the actuator and the ice cube tray, wherein the stopper is provided in one side of the supporting bracket.

5. The icemaker according to claim 4, wherein the ice cube tray is formed with an ice-releasing portion at one side thereof to come into contact with the stopper.

6. An icemaker comprising:

an ice cube tray formed with two rows of cube compartments;

an actuator which rotates the ice cube tray; and a stopper coming into contact with the ice cube tray being rotated and allowing the ice cube tray to be twisted;

wherein the cube compartments are diagonally arranged with respect to a lengthwise direction of the ice cube tray; and wherein the cube compartments in a first row of the two rows have longitudinal directions substantially parallel to longitudinal directions of the cube compartments in a second row of the two rows.

7. The icemaker according to claim 6, wherein the longitudinal directions of the cube compartments are arranged at an angle of about 40°~50° with respect to the lengthwise direction of the ice cube tray.

8. The icemaker according to claim 6, wherein each of the cube compartments has an oblong shape.

9. The icemaker according to claim 8, wherein the cube compartments have a crescent shape.

10. The icemaker according to claim 6, further comprising a supporting bracket supporting the actuator and the ice cube tray, wherein the stopper is provided in one side of the supporting bracket.

11. The icemaker according to claim 10, wherein the ice cube tray is formed with an ice-releasing portion at one side thereof to come into contact with the stopper.

* * * * *